United States Patent [19]

Dutcher et al.

[11] 4,032,061

[45] June 28, 1977

[54] POUR SPOUT

[75] Inventors: Daniel P. Dutcher, Shoreview; Edwin C. McLaren, Apple Valley, both of Minn.

[73] Assignee: Hoerner Waldorf Corporation, St. Paul, Minn.

[22] Filed: Apr. 12, 1976

[21] Appl. No.: 675,769

[52] U.S. Cl. ..... 229/17 R; 229/51 TC; 229/51 D

[51] Int. Cl.[2] ..... B65D 5/72

[58] Field of Search ..... 229/17 R, 51 TC, 51 D

[56] References Cited

UNITED STATES PATENTS

| | | | |
|---|---|---|---|
| 1,286,038 | 11/1918 | Lowy | 229/17 R |
| 2,276,577 | 3/1942 | Hahn | 229/51 D X |
| 2,364,439 | 12/1944 | Guyer | 229/17 R |
| 3,521,809 | 7/1970 | Zimmerman | 229/17 R |
| 3,570,745 | 3/1971 | Aoki | 229/17 R |
| 3,708,109 | 1/1973 | Rosenburgh, Jr. | 229/51 TC X |

*Primary Examiner*—Davis T. Moorhead
*Attorney, Agent, or Firm*—Jerry F. Best

[57] ABSTRACT

A hinged pour spout for the upper corner of a rectangular paperboard carton which is formed integrally with the blank and can be reinserted to close the opening after use.

1 Claim, 7 Drawing Figures

POUR SPOUT

BACKGROUND OF THE INVENTION

1. Field of the Invention

This invention relates to cartons having dispensing means formed as an integral part of the panels of the carton.

2. Description of the Prior Art

Present pour spouts in cartons are of the metal type which pivot outwardly and are clamped with prongs into a die-cut or partially die-cut section of the carton. There is a need for a pour spout configuration which is incorporated into the panels of the carton allowing it to be sealed on conventional automatic equipment without modification as a regular seal end carton thereby eliminating the cost of the metal spout and equipment therefor.

SUMMARY OF THE INVENTION

An easily insertable tab extending above a side wall of a carton and sealed to a removable portion of the first folded major flap with frangible line cuts connecting it to a hinge line which defines the bottom of the aperture, the tab being insertable between the major flaps to close the carton spout.

DETAILED DESCRIPTION OF THE PREFERRED EMBODIMENT

Figure 5:
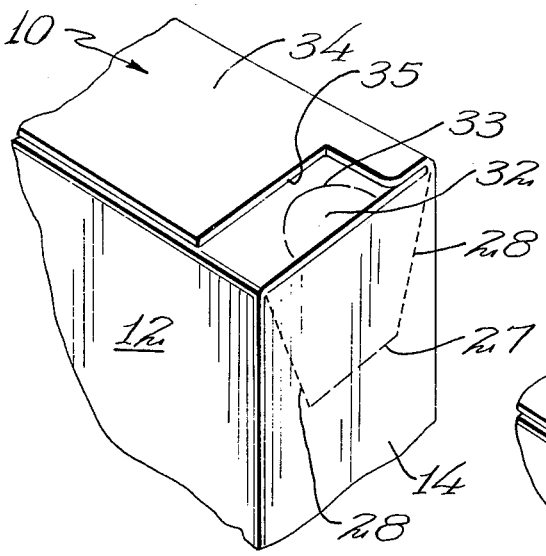
FIG. 5 is a perspective view of a portion of a carton as in FIG. 1 as it appears sealed before opening.

A conventional rectangular carton 10 is suitable for use in this invention and is formed from a blank 11 having front and back wall panels 12 and 13 along with side wall panels 14 and 15. These are connected along parallel vertical fold lines 16, 17 and 18.

The top and bottom edges of the blank 11 are defined by parallel horizontal fold lines 19 and 20. One lateral edge of the blank 11 is defined by a vertical fold line 21 to which is attached a manufacture's glue flap 22.

Along the bottom edge of the blank 11 are closure flaps of conventional form 23, 24, 25 and 26 hingedly attached along the fold line 20 to the panels 12, 14, 13 and 15 respectively. These are folded and glued to form a bottom closure for the carton 10.

The top closure flaps and a first side wall panel 14 incorporate the spout. The top of the panel 14 has a fold line 27 extending partly across it horizontally and has upwardly extending frangible score lines 28 extending from the ends thereof to the corners of the panel 14 at the level of the fold line 19. Connected along the top edge the panel 14 along the fold line 19 is an insertable tab 29 which preferably has a rounded upper edge but is not restricted thereto, which edge is insertable as described below for reclosure.

Figure 3:
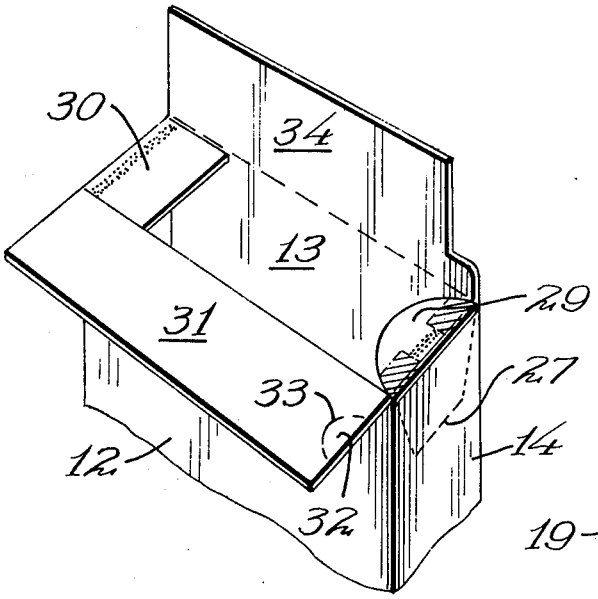
FIG. 3 and 4 illustrate the following sequence of the blank of FIG. 2.

The opposite side wall panel 15 has a minor closure flap 30 hingedly attached to the top edge thereof along the line 19. The tab 29 and flap 30 are first folded inwardly to effect the closing of the top of the carton 10 after the wall panels are put together in rectangular tube-like configuration. This is seen in FIG. 3.

Figure 4:
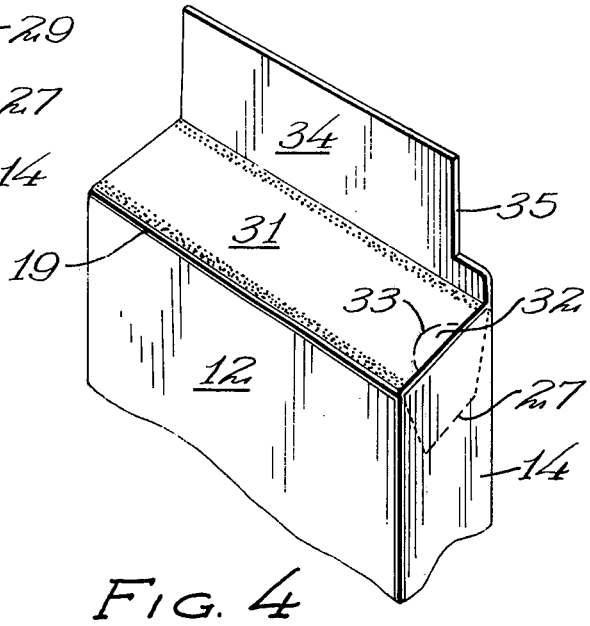
Figure 2:
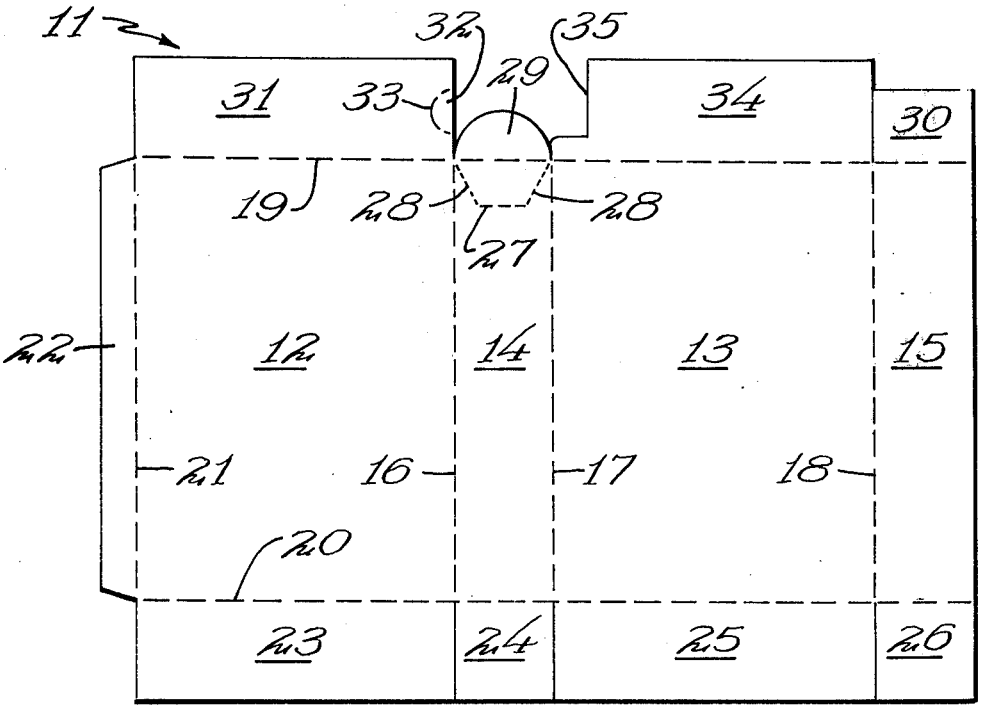
FIG. 2 is a plan view of a die-cut blank adapted to be folded into a carton having a spout such as that shown in FIG. 1.

The next step is shown in FIG. 4 and is the folding of the major flap 31, which is shown attached along the top edge 19 of the front panel 12. This flap 31 covers substantially the entire area of the top of the carton 10 and is adhered to the flap 30. At the opposite end it overlies the tab 29. Since the tab 29 must be removable, it cannot be permanently affixed to the overlying flap 31. Therefore, a removable section 32 is formed in the end of the flap 31 and can be broken free by pressing down on the frangible score line 33. The section 32 is glued to the tab 29 either by selective application of the adhesive, or by selective application of ink to which the glue will not adhere or on which it will not deposit even upon contact. This latter technique is illustrated in the drawings in FIG. 3, with the stippled shading representing the adhesive and the lined shading reprenting the adhesive and the lined shading representing the noncompatible ink.

The outer major flap 34 is attached along the hinge line 19 to the top edge of the back panel 13 and has a notch 35 cut from it to facilitate access to the area which must be pressed to break the line 33 and hence free the tab 29. The major flaps 31 and 34 are glued together as in FIG. 4.

Figure 1:
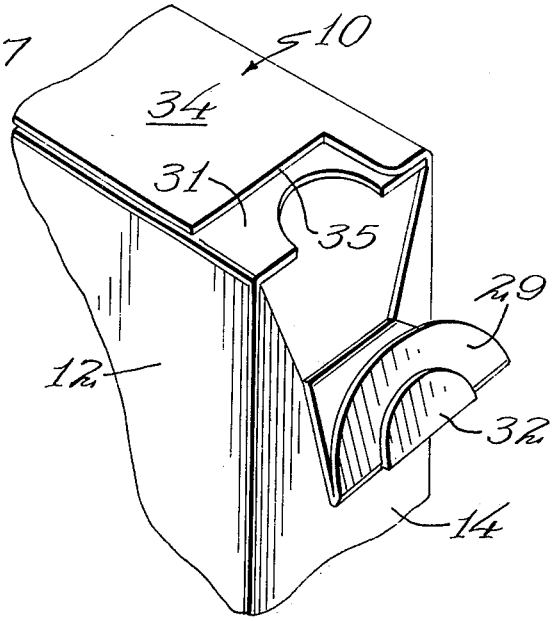
FIG. 1 is a perspective view of a portion of a rectangular carton with a spout such as is disclosed in the present invention, showing the spout open.
Figure 6:
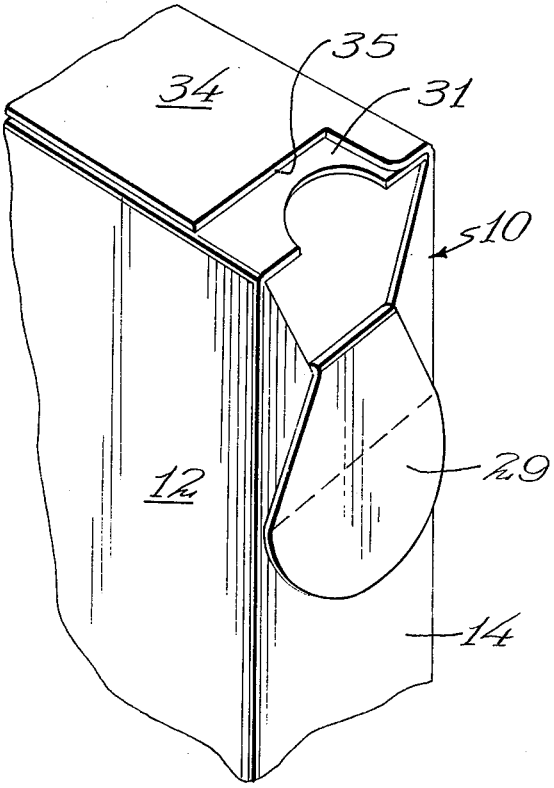
FIG. 6 shows the appearance of the carton with the spout open.
Figure 7:
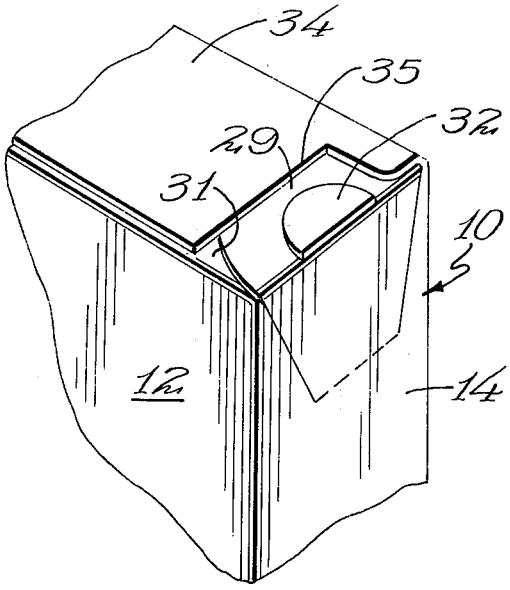
FIG. 7 illustrates the reclosable feature of the spout as disclosed in the present invention.

The carton 10 is opened by pulling the tab 29 with the section 32 attached thereto outwardly, after the line 33 is broken, to sever the lines 28 and expose the pouring opening as in FIGS. 1 and 6. The tab may simply be inserted between the edges of the flaps 31 and 34 to reclose as shown in FIG. 7.

We claim:

1. A rectangular, tube like carton having bottom closure flaps and a top closure, said top closure including an improved reclosable pour spout, said closure and spout comprising:

an insertable tab hingedly attached to a first side wall panel of said carton and foldable inwardly along with a minor closure flap on the opposite side wall panel;

a section of said first side wall panel adjacent said insertable tab hingedly connected to said tab and having a pair of laterally spaced-apart frangible score lines connected along their bottom ends by a horizontal fold line to define a spout opening;

a first folded major flap contacting the top surface of said tab;

said first folded major flap having a removable section formed therein and defined by a frangible score line, said section in said flap positioned above and adhered to said tab; and an outer major flap positioned above said first folded major flap and adhered thereto except in the area adjacent to said tab so that said tab and said removable section are insertable between the edges of said major flaps to reclose said spout opening.

* * * * *